US006326134B1

(12) United States Patent
Lobo et al.

(10) Patent No.: US 6,326,134 B1
(45) Date of Patent: Dec. 4, 2001

(54) PROCESS FOR MANUFACTURE OF PHOTOGRAPHIC EMULSION

(75) Inventors: Lloyd A. Lobo, Webster; Sridhar Sadasivan, Rochester; John W. Boettcher, Webster; Seshadri Jagannathan, Pittsford; Jerzy A. Budz, Fairport; David C. Gliottone, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/645,625

(22) Filed: Aug. 24, 2000

(51) Int. Cl.[7] ..... G03C 1/005; G03C 1/494

(52) U.S. Cl. ..... 430/569; 430/449; 430/631; 430/637; 430/640

(58) Field of Search ..... 430/569, 449, 430/631, 637, 640

(56) References Cited

U.S. PATENT DOCUMENTS

| | | | |
|---|---|---|---|
| 3,501,304 | 3/1970 | Koda et al. . | |
| 3,615,519 | 10/1971 | Milton . | |
| 3,666,477 | 5/1972 | Goffe . | |
| 3,706,562 | 12/1972 | Herz et al. . | |
| 3,785,823 | 1/1974 | Bigelow . | |
| 3,895,948 | 7/1975 | Shiba et al. . | |
| 4,001,020 | 1/1977 | Hayashi et al. . | |
| 5,147,771 | 9/1992 | Tsaur et al. . | |
| 5,147,772 | 9/1992 | Tsaur et al. . | |
| 5,147,773 | 9/1992 | Tsaur et al. . | |
| 5,587,282 | 12/1996 | Nakatsugawa et al. . | |
| 5,681,692 | 10/1997 | Orem et al. . | |
| 6,143,484 * | 11/2000 | Schroeder et al. | 430/631 |

FOREIGN PATENT DOCUMENTS 1 362 970 8/1974 (GB) .

OTHER PUBLICATIONS

Research Disclosure, Jan. 1995, Item 36929, titled "Anti-foam Materials For Manufacturing Photographic Elements", pp. 29–30.

* cited by examiner

*Primary Examiner*—Geraldine Letscher
(74) *Attorney, Agent, or Firm*—Andrew J. Anderson

(57) ABSTRACT

A process for forming a silver halide photographic emulsion is disclosed comprising precipitating silver halide grains in an aqueous dispersing medium to which has been added silver and halide salt solutions while agitating the dispersing medium, wherein the precipitation is done in the presence of an antifoamant compound of the formula $RO(CH_2CH_2O)_nH$ wherein R represents an alkyl or alkenyl group containing 10 to 25 carbon atoms, or mixtures thereof, and n represents a mean value of from 2 to 4. The antifoamant material may be delivered to the aqueous dispersing medium as a small particle dispersion, made with the same peptizer used for manufacturing the emulsion or another stabilizer. A further embodiment of the invention is directed towards a silver halide photographic material comprising a support upon which is coated at least one light sensitive silver halide emulsion layer, comprising a silver halide emulsion precipitated in accordance with the described process.

15 Claims, No Drawings

PROCESS FOR MANUFACTURE OF PHOTOGRAPHIC EMULSION

FIELD OF THE INVENTION

This invention relates to the manufacture of silver halide photographic emulsions, and in particular to a process for the precipitation of silver halide grains in the presence of an antifoamant compound.

BACKGROUND OF THE INVENTION

Silver halide photographic emulsions are manufactured by introducing the reagents—typically aqueous solutions of silver nitrate and a halide salt—into a reactor, where the fluid is well mixed such as by using a rotary agitator. The high level of mixing is accomplished by high speed stirring and turbulence in the fluid. The nucleation and the growth process, and hence the properties of the photographic emulsion grains, are directly affected by the extent of mixing in the reactor. Therefore, in order to minimize variability in the photographic performance of the emulsion, a high level of mixing is maintained throughout the time of the precipitation reaction. Additionally, emulsions are typically precipitated in the presence of a peptizer, which is usually gelatin, to maintain the colloidal stability of the particles. The use of high speed stirring results in the entrainment of air, which in the presence of gelatin leads to the formation of a stable foam. The volume of the foam continues to increase during the reaction, which is undesirable for several reasons. For one, the foam and the air bubbles interfere with the mixing conditions and can cause several dead reaction zones—leading to polydispersity in the properties of the resulting emulsion. The most serious problem of foam is that it occupies a significant volume in the reactor, which reduces the capacity of the reactor to produce a desired volume of the emulsion. Thus, foam generation directly affects productivity of a manufacturing operation.

In order to minimize problems encountered due to foam, some form of foam control is generally used. Chemical antifoamers that are added to the reactor can be classified as three distinct types: 1) defoamers that are added to break up a foam; 2) insoluble inorganic or organic materials; and 3) partially soluble or dispersible surface active materials.

Examples of defoamers of type 1) include alcohols such as butyl alcohol, octyl alcohol etc. The deficiency of these materials is that their antifoaming action is short term. That is, they are able to break the foam at the time of addition but cannot prevent subsequent formation of foam. Thus, they need to be added continuously resulting in large quantities of these materials associated with the emulsion. The presence of these materials can cause further problems in manufacturing operations where the emulsions are used, such as surface tension modification and vaporization. Thus, these materials are not generally desired.

Examples of insoluble organic materials of type 2) include silicone and paraffin oils. Frequently, these materials are made more effective by adding inorganic particles such as hydrophobic silica. These materials are quite effective at relatively low concentrations, and have a sustained antifoaming action. Also, these materials are non-volatile. This class of materials are disclosed in *Research Disclosure* 36929 (*Research Disclosure* is published by Kenneth Mason Publications, Ltd., Dudley House, 12 North Street, Emsworth, Hampshire P010 7DQ, ENGLAND). While these materials perform well as antifoamants in the reactor, they have catastrophic drawbacks in subsequent manufacturing operations, due to their interaction with other manufacturing hardware, such as UF membranes and filter membranes, which are a necessary part of the emulsion manufacturing process. Specifically, these insoluble materials foul ultrafiltration membranes which are used to deionize the emulsions, and they also plug filter media. Their most serious problem is that they are prone to form coating defects during the coating of solutions on photographic support. Creation of a large concentration of coating defects can make a product unusable. The details of the way these materials act to defoam as well as broad range of examples of these kinds of materials are given in "Defoaming", P. R. Garrett Ed., Surfactant Science Series, Vol. 45, Marcel Dekker, N.Y. 1993.

The third class of materials are partially soluble or dispersible surface active materials. These materials dissolve in the aqueous gelatin solution or disperse into very small drops, thereby minimizing the above mentioned problems. Examples of these materials include polyethylene oxide (EO)-polypropylene oxide (PO) block copolymers. U.S. Pat. Nos. 5,147,771, 5,147,772 and 5,147,773 disclose materials of this general class as grain growth modifiers to produce monodisperse emulsions. U.S. Pat. No. 5,587,282 discloses that among these materials, those having a PO content of 80% or more are effective as antifoamers. Other examples of these materials are disclosed in Res. Disc. 36929, as di and mono alkyl or alkenyl esters of polyethylene glycol having low water solubility. U.S. Pat. No. 5,587,282 also discloses polyalkylene oxide modified poly(dimethylsiloxane) fluids as antifoaming agents. All these examples fall under the general class of polyalkylene oxide containing organic materials with low solubility in water.

The general problem experienced by this class of materials is that, if the polyalkylene oxide content of the material is high, the potential of these materials to adsorb to the silver halide surfaces is high. This can result in grain growth modification as disclosed in U.S. Pat. Nos. 5,147,771, 5,147,772 and 5,147,773. While the use of growth modifiers for photographic emulsions may be useful in some instances, the growth modification property of this class of materials makes them unusable as a general purpose antifoamant. In many instances, the growth modification process which results from the interaction of the antifoamant with silver halide emulsion can be severe enough to induce agglomeration as disclosed in U.S. Pat. No. 5,681,692. It is generally believed that this occurs because the polyalkylene oxide, specifically polyethylene oxide, part of the molecule has specific interactions with the silver halide surface. This results in its being adsorbed in preference to the usual peptizing agent that is used, thereby reducing the colloidal stability of the grains. However, if the polyalkylene oxide content of the material is low, the solubility or dispersibility of these materials in the gelatin solution is not adequate. This results in large drops of the antifoamant being present in the emulsion. The large drops can cause filtration problems as well as coating defects. In addition, the size of the drops and the severity of the problems they can cause, is variable, as the formation of these drops depends on the stirring conditions of the reactor. Another problem is that these materials, being hydrophobic, may adhere to the surfaces of the hardware of the reactor.

Thus, it is desirable to have a material that acts as an antifoamant which can be dispersed in a reproducible manner, in the reactor, without interacting with the surfaces of the silver halide grains and the manufacturing hardware, so as to manufacture emulsions that have superior photographic performance.

SUMMARY OF THE INVENTION

An object of this invention is to provide foam control during the manufacture of photographic silver halide emulsions, by using a chemical antifoamant.

Another object of this invention is for the chemical antifoamant to be added to the reactor in such a state so as to disperse it as fine droplets in a reproducible manner.

A further object of this invention is for the chemical antifoamant to have no observable interactions with the silver halide surface, in terms of the physical properties of the emulsion or photosensitive behavior of the emulsions.

Another further object of this invention is that the antifoamant material be effective at foam control, by using relatively small quantities with respect to the gelatin solution.

In accordance with one embodiment of the invention, in a process for forming a silver halide photographic emulsion comprising precipitating silver halide grains in an aqueous dispersing medium to which has been added silver and halide salt solutions while agitating the dispersing medium, the improvement is described wherein the precipitation is done in the presence of an antifoamant compound of the formula $RO(CH_2CH_2O)_nH$ wherein R represents an alkyl or alkenyl group containing 10 to 25 carbon atoms, or mixtures thereof, and n represents a mean value of from 2 to 4.

In a preferred embodiment, the antifoamant material is delivered to the aqueous dispersing medium as a small particle dispersion, made with the same peptizer used for manufacturing the emulsion or another stabilizer.

A further embodiment of the invention is directed towards a silver halide photographic material comprising a support upon which is coated at least one light sensitive silver halide emulsion layer, comprising a silver halide emulsion precipitated in accordance with the described process.

DETAILED DESCRIPTION OF THE INVENTION

The antifoamant compounds employed in accordance with the invention fall under a general class of surfactants/materials described as ethoxylated alcohols. The synthesis of such materials is described in Nonionic Surfactants, Ed. Martin Schick, Surfactant Science Series, Vol. 1., Marcel Dekker Inc. Preferably, R represents an alkyl or alkenyl group of from 16 to 18 carbon atoms, more preferably 18 carbon atoms, and n represents a mean value of from 2 to 3. Most preferably, the antifoamant is a polyoxyethylene ether of oleyl alcohol of the formula $C_9H_{18}{=}C_9H_{17}O(CH_2CH_2O)_nH$. Although, it is possible to obtain a pure form of a single compound for use in accordance with the invention with careful purification steps, the commercial forms of these materials have a distribution in the number of ethylene oxide units per molecule. The nominal amount of ethylene oxide units in the most preferred material formula is 2 ethylene oxide groups per molecule; however, there may be molecules having up to 4 ethylene oxide units in commercial samples. Examples of commercial polyoxyethylene ether of oleyl alcohol materials for use in accordance with the invention include Brij 92 and Brij 93, made by ICI Surfactants, Lipocol O-2, made by Lipo Chemicals Inc., and Amerexol OE-2 made by Amerchol Inc. All these materials are in general described by the formula $C_9H_{18}{=}C_9H_7O(CH_2CH_2O)_n$ H but with varying degrees of purity.

Precipitation of silver halide emulsions in a dispersing medium for photographic applications is generally carried out by a single jet addition of an aqueous solution of silver nitrate or a double jet addition of an aqueous solution of silver nitrate and an aqueous solution of alkali halide to a reactor containing water, gelatin and alkali halide, typically maintained at a temperature ranging from 40–80° C., with vigorous mixing. The molar concentrations of the silver nitrate and the alkali halide solutions are typically greater than 0.5 and the gelatin concentration in the reactor at the beginning of the precipitation process generally range from 0.2–6% by weight. Phenomenologically, the precipitation process may be separated into the following segments.

Nucleation: This is typically carried out by the single jet addition of silver nitrate solutions or by the double jet addition of silver nitrate and alkali halide solutions for a short period of time into a reactor containing alkali halide, gelatin and water. The gelatin concentration may range from 0–6% by weight.

Ripening: The number silver halide crystals generated from the nucleation step is reduced to a desired number by Ostwald ripening, by increasing their solubility in the reactor. Increase in the reactor temperature and addition of a silver ion chelating agent are typical procedures for accelerating the ripening process.

Addition of more gelatin: The crystals obtained from the ripening step are stabilized by adding more gelatin. The concentration of gelatin in the reactor at the end of this step is typically greater than 1% by weight.

Growth: The crystals obtained from the previous step are grown to a desired size by a single jet silver nitrate addition process or a double jet silver nitrate and alkali halide addition process or the addition of preformed silver halide seeds or a combination of all three processes. At the end of the growth process the gelatin concentration in the reactor is typically less than 6% by weight and the ionic strength of the reactor is very high, close to saturation.

The peptizer used in the manufacture of emulsions is typically gelatin. This may be gelatin in its natural state or a modified gelatin such as acetylated gelatin, phthalated gelatin, oxidized gelatin, etc. Gelatin may be base-processed, such as lime-processed gelatin, or may be acid-processed, such as acid processed ossein gelatin or acid processed pig skin gelatin. It is specifically contemplated to use gelatin containing a low level of methionine (e.g., oxidized gelatin containing less than 30 $\mu$moles of methionine per gram) as a peptizer in the process of the invention. Additionally, other known silver halide grain peptizers may be used, such as synthetic polymeric compounds and starch compounds.

The antifoamants used in accordance with the present invention can be added at any point of the emulsion manufacturing process depending on the need for foam control. In general, it is preferred that the total amount of antifoamant added to the dispersing medium is from 1 ppb (part per billion) to 1%, more preferably 1 ppm (part per million) to 0.1%, and most preferably 0.002% to 0.025% of the total weight of the emulsion that is made.

As outlined above there are several sequential steps in the precipitation step for emulsions. During the formation of nuclei, ripening and the subsequent growth of the nuclei, it is important to eliminate concentration gradients of the reactants, which is accomplished by agitation. A stable foam is formed by the entrained air which is stabilized by the gelatin. The antifoam can be added prior to introduction of reagents or during the growth process, depending on the amount of gelatin that is present at different points of the reaction. After the reaction, the emulsion is subsequently desalted and concentrated. This can be accomplished by several methods—by membrane separation technologies like ultrafiltration or by electrodialysis or by phase separation techniques using acidic or alkaline sedimenting agents. In the membrane separation processes, the emulsion is pumped through restricted passage ways, resulting in cavitation which causes a foam build up. In phase separation processes, foam or entrained air from the reaction step hinders the separation step. Thus, the antifoam may be added, or its concentration increased, in the step for desalting and concentration. During the chemical sensitizing step, as in the reaction step, agitation of the fluid is desired to minimize concentration gradients of the sensitizers as they are added. Thus, antifoams are needed for the same reason that they are needed during the reaction step.

In a preferred embodiment, the antifoam is first made into a small particle dispersion prior to its being added to the emulsion dispersing medium. The small particle dispersion can be prepared as follows: The liquid antifoamant is mixed with an aqueous solution containing one or more stabilizers. The concentration of antifoamant in the formed dispersion may be between 0.1 and 50 weight percent. The most common stabilizers are surfactants which may be cationic, anionic, zwitterionic or non-ionic. Ratios of surfactant to the antifoamant typically are in the range of 0.5 to 25 weight percent for forming small particle dispersions. Particularly preferred surfactants which may be employed in the present invention include an alkali metal salt of an alkarylene sulfonic acid, such as the sodium salt of dodecyl benzene sulfonic acid, the sodium salt of isopropylnaphthalene sulfonic acid or a mixture of sodium salts of mono, di, and tri isopropylnaphthalene sulfonic acid; an alkali metal salt of an alkyl sulfuric acid, such as sodium dodecyl sulfate; or an alkali metal salt of an alkyl sulfosuccinate, such as sodium bis (2-ethylhexyl) succinic sulfonate. In addition to the surfactant other hydrophilic high molecular weight stabilizers may be present. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly(vinylacetate-co-vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used. Among these it is preferred to use gelatin, which is the typical peptizer used to make emulsions. The amount of gelatin preferably may vary between 1 to 25 weight percent of the aqueous solution, and is typically present at 10% to 1000% relative to the amount of the antifoamant in the dispersion.

In order to prepare the dispersion, the mixture of the aqueous phase and the antifoam is then passed through a mechanical mixing device suitable for high-shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The dispersion particles generally have an average particle size from about 0.02 to 100 microns, preferably less than 2 microns, more preferably from about 0.02 to 0.5 micron. The dispersion of the antifoam can be made into a gel by lowering its temperature to below 20° C. and then stored at temperatures between 0 and 10° C. In order to enhance the shelf life and prevent attack by biological agents, a suitable biocide such as KATHON (5-chloro-2-methyl-4-isothiazoline-3-one and 2-methyl-4-isothiazolin-3-one) may be added at the required concentration, which for KATHON is between 5 and 100 ppm based on the weight of the dispersion.

The antifoamant disclosed in this patent does not interact with silver halide emulsions of any halide composition and hence can be used as antifoamants in the precipitation of any silver halide emulsions in an aqueous gelatin medium. Examples of silver halide composition include (but are not limited to) silver bromide, silver chloride, silver iodide, silver bromo iodide, silver bromo chloride, silver bromo iodo chloride and silver chloro iodide, the ratio of the various halides in the emulsion ranging from 0–100%. The halide composition refers to the composition in the individual grains and the emulsion can be a mixture of grains with varying compositions. The gelatin used in the precipitation process include (but is not limited to) all combinations of oxidized or nonoxidized, chemically modified or non-chemically modified, and deionized or non-deionized gelatin of any molecular weight. The extent of oxidation, chemical modification and deionization can range individually from 0–100% and the overall gelatin content (molecular weight, extent of oxidation and chemical modification) may be polydisperse. The physical characteristics of the silver halide emulsion, such as morphology may be (but is not limited to) 3-dimensional (e.g., cubic, octahedral, cubo-octahedral) or 2-dimensional (e.g., tabular grains with {111} or {100} major surfaces) or a combination of various morphologies in any ratio and the size of these emulsions may range from 0.01 $\mu$m to 10 $\mu$m or greater. The size dispersity can range from less than 5% to greater than 50%. Any combination of silver halide composition, morphology, size and gelatin can be manufactured using these antifoamants.

We have found several advantages by using specific ethoxylated alcohol compounds in accordance with the present invention.

1) It is excellent at preventing foam and breaking up a foam, that is formed in any solution that contains gelatin. It is also effective over a wide temperature range, which can be encountered during emulsion manufacture.

2) It does not interact with the surface of the silver halide grains, even in the most susceptible emulsion formulas, thereby avoiding such deleterious effects like clumping of the emulsion grain, or undesired grain growth modification.

3) It does not foul the membranes used in desalting and concentrating emulsions

4) It does not plug filter media used in the process of coating photographic elements using these emulsions.

5) It can be made into a dispersion that allows instantaneous and uniform dispersal of the antifoamant.

6) Enhanced photographic performance in the form of improved keeping.

The present invention is described in more detail by means of the following examples, which, however, are not intended to restrict the scope of the present invention.

EXAMPLES

Description of Antifoams

The antifoams used in the following examples are listed below:

A1—Polyoxyethylene ether of oleyl alcohol, 2EO (Brij93, manufactured by ICI).

A2—comparative antifoamant—Dioleate ester of polyethylene glycol, 4-5EO, (Mapeg 200 DO, manufactured by BASF).

A3—comparative antifoamant—Polyoxyethylene ester of dodecyl alcohol, 5EO (Brij 30, manufactured by ICI).

A4—comparative antifoamant—Dioleate ester of polyethylene glycol, 9-10EO (Emerest 2648, manufactured by Henkel).

A5—comparative antifoamant—Propylene oxide/ethylene oxide tri-block polymer (Tetronic 90R4 manufactured by BASF).

Example 1

The antifoaming efficacy of comparative antifoamant A2 and antifoamant A1 in accordance with the invention was tested as follows: 300 ml of 2% gelatin solution was taken in a jacketed 1 L volumetric cylinder. The required amount of the antifoam dispersion was added to achieve the desired concentration of the active ingredient in the gelatin solution. The temperature of the jacket was maintained at 60° C. Nitrogen was bubbled from the bottom of the cylinder at rate of 800 ml/min, through a diffuser stone. The final steady state height of the foam generated is noted down. If the height exceeded the volume of the cylinder (1 L), the gas generation was ceased, and the time for the foam to decay to half its volume (½ L) was measured. For each antifoam the measurement was done for the antifoam added in its native state and also added in the form of a small particle dispersion. The small particle dispersion composition were prepared as follows: Antifoam was added to a solution of gelatin with Alkanol XC to give final weight percent concentrations of 10% antifoam, 10% gelatin and 0.5% Alkanol XC. The mixture was dispersed by a Silverson rotor stator mixer at a speed of 5000 rpm, for 5 minutes. The coarse dispersion was then passed through a homogenizer at 5000 psi. The particle sizes of both antifoam dispersions were below 0.5 $\mu$m.

TABLE 1

| Antifoam | form of antifoam | concn. of active ingredient | max. foam height | time to decay to ½ L |
|---|---|---|---|---|
| A2 (comp) | native state | 100 ppm | 900 ml | 28 secs |
| A2 (comp) | small particle dispersion | 100 ppm | 1000 ml | 12 minutes |
| A1 (inv) | native state | 100 ppm | 900 ml | 45 secs |
| A1 (inv) | small particle dispersion | 100 ppm | 690 ml | 20 secs |

Although both the antifoams are effective in the native state, efforts to improve the dispersibility of A2 by making a small particle dispersion significantly reduces its ability to control foams. The invention A1 is as effective in its native state as well as in its small particle dispersion form.

Example 2

In order to compare the performance of the different antifoams, several tests were performed as described below:

Antifoaming Efficacy

The antifoaming efficiency was characterized by the maximum volume of a gelatin solution that can be held in a reactor under reaction conditions. The test was carried out in a 1800 L reactor as follows: 450 L of a 6% Type IV gelatin solution, containing the required amount of the antifoam, was first added to the reactor. The temperature of the solution was maintained at 60° C. The reactor stirrer was then started and maintained at a speed of 650 rpm for 5 minutes, after which water, at 60° C. was added to the reactor at a rate of 30 kg/min, while the stirrer speed was ramped at 16 rpm/min till it reached a maximum speed of 1000 rpm. When the height of the liquid and the foam reached the top of the kettle, the amount of liquid added to the kettle was noted. The percent efficiency is defined as:

$$(\text{volume of liquid at end of experiment})/1800\ \text{L}\times 100$$

Dispersibility

The dispersibility of an antifoam is evaluated by adding the antifoam, in the amount appropriate for antifoaming, to a 2 Kg gelatin solution, at 40° C., which is gently stirred. Visual observations of the ability to disperse are made.

Plugging of Filters and Interaction with Silver Iodide Emulsions

The propensity of the antifoam to plug filters and the propensity to interact with silver iodide emulsions was measured by a filtration technique. The emulsion was precipitated in a gelatin which was oxidized to reduce the methionine content of the gelatin to less than 30 $\mu$mole per gram of emulsion. The size of the grains was 0.06 $\mu$m. The combination of a silver iodide emulsion, small grain size and low methionine content of the gelatin, makes the emulsion sensitive to destabilization. Thus, if the antifoam has any interaction with the silver iodide emulsion, it destabilizes the emulsion which then forms aggregates or clumps in the gelatin medium. The extent of aggregation or clumping can be judged from the filtration characteristics of the emulsion with the antifoam. The filtration test unit consists of a temperature controlled, pressurizable 3 L reservoir with a 47 mm diameter filter holder connected to the bottom outlet. The filter holder is loaded with a 47 mm diameter disk of the chosen filter medium. A fiberglass medium of average pore diameter 2 to 4 $\mu$m is used. The reservoir is filled with 300 grams of the emulsion maintained at 40° C. for 30 minutes with the antifoam. The top is capped and the unit is pressurized to 1.5 psig by a pressure regulator. The filtrate is collected in a beaker on an electronic balance. The output from the balance is fed into a computer with a software program that collects cumulative filtrate weight as a function of time. The collected data has been analyzed using a Standard Blocking Model as described by Hermans and Bredee in J.Soc. Chem. Ind., 55T, 1(1936). According to this model, inverse filtration rate is plotted against time. The slope indicates the plugging of the filter. The higher the slope, higher is the degree of plugging. The propensity of the antifoams themselves to plug filters is given by the slope obtained when filtering a gelatin solution containing antifoams. The propensity of the antifoam to interact with an emulsion is given by:

$$\begin{bmatrix}\text{slope obtained by}\\ \text{filtering an emulsion}\\ \text{with antifoam}\end{bmatrix} - \begin{bmatrix}\text{slope obtained by filtering}\\ \text{a gelatin solution with}\\ \text{antifoam}\end{bmatrix}$$

This difference is called the emulsion interaction parameter. Hence, the filtration experiments provide two distinct pieces of information: (1) the propensity of the antifoam to plug filters and (2) the propensity to interact with AgI emulsions.

Antifoamant A1 (invention) was made into a dispersion in gelatin before adding it to the gelatin solution in the reactor, as it did not disperse well when added directly to the gelatin solutions. The method of preparing the dispersion is as follows: 100 grams of liquid 1 (antifoamant) was added to 900 grams of a gelatin solution containing Alkanol XC (a mixture of di-isopropyl and tri-isopropyl naphthalene sodium sulfonate) to give final weight percent concentrations of 10% antifoamant, 10% Type IV gelatin and 0.5% Akanol XC at a temperature of 40° C. 15 ppm of Kathon was added as a biocide. The mixture was coarsely dispersed by stirring with a magnetic stirrer. The coarse dispersion was then passed through a high pressure homogenizer. The resulting product was examined under a microscope and the dispersed particle sizes were observed to be less than 0.5 $\mu$m. The product was stored at <10° C. so that it formed a gel.

Antifoamant A2 (comparison) was added directly to the gelatin solutions, but dispersed poorly. A small particle dispersion was not employed, as such procedure reduced efficiency in Example 1.

Antifoamants A4 and A5 (comparisons) were added directly to the gelatin solutions, and effectively dispersed into small drops.

The results obtained from the filtration experiments are summarized in Table 2.

TABLE 2

| Antifoam | Concentration (ppm) | Slope (from gelatin solution) × 1000 | Slope (from Emulsion) × 1000 | Difference in Slope (Emulsion Interaciton Parameter) × 1000 |
|---|---|---|---|---|
| A5 (comp) | 25 | | Filter plugged severely | Not measurable |
| A4 (comp) | 150 | 0.147 | 5.29 | 5.143 |
| A2 (comp) | 100 | 3.51 | 3.17 | 0.34 |
| A2 (comp) | 200 | 6.9 | 7.68 | 0.78 |
| A1 (inv) | 50 | 1.1 | 1.2 | 0.1 |
| A1 (inv) | 100 | 2.1 | 2.5 | 0.4 |

The inventive antifoamant A1 has much smaller interaction with the filter medium than comparative antifoamant A2, as evidenced by the smaller value of the slope obtained when filtering a gelatin solution. Further, it does not significantly interact with the emulsion, unlike the comparison antifoamants A4 and A5. Based on the emulsion interaction parameter, the high value of the slope for A4 shows that it has a high propensity to interact with the silver iodide emulsion and cause clumping, whereas the invention antifoamant A1 has a very low slope, indicating a low propensity for interaction with the silver iodide emulsion. Comparison antifoamant A5 in fact completely destabilized the emulsion, rendering it unfilterable. Thus, the invention antifoamant A1 is superior in performance to the comparative antifoams A5, A4 and A2.

Results obtained with various tests are further summarized in Table 3.

TABLE 3

| Antifoam used/ amount used | % efficiency | Dispersibility | Filter plugging propensity | Emulsion interaction |
|---|---|---|---|---|
| None | 82.6 | — | — | — |
| A5/25 ppm | | good | | Yes |
| A4/150 ppm | 92 | fair-small drops (<1 mm) are formed | No | Yes |
| A2/200 ppm | 88.3 | poor-large drops (>1 mm) which phase separate on standing | Yes | No |

TABLE 3-continued

| Antifoam used/ amount used | % efficiency | Dispersibility | Filter plugging propensity | Emulsion interaction |
|---|---|---|---|---|
| A2/100 ppm | 85.6 | as above | Yes | No |
| A1/50 ppm | 90 | good-drop size is similar to dispersion | No | No |
| A1/100 ppm | 91 | as above | No | No |

As seen above, the invention has all the desired features of a good antifoam—no interaction with filters, and non-interaction with silver iodide emulsions.

Example 3

The antifoaming efficiency of antifoamants A3 and A1 were evaluated by the method described in Example 1. Both the materials were added directly to the gelatin solution at varying antifoam concentrations (25, 50, and 100 ppm). The materials were also evaluated for interaction with silver iodide emulsions, at 300 ppm in the emulsion, as described in Example 2 (Emulsion interaction parameter defined as difference in slope×1000). Table 4 shows the results.

TABLE 4

| Antifoam type | Antifoam concentration ppm | Maximum foam height | Time to decay | Emulsion interaction parameter |
|---|---|---|---|---|
| A3 (comp) | 25 | 1000 | 5.5 min | |
| A3 (comp) | 50 | 1000 | 3.5 min | |
| A3 (comp) | 100 | 1000 | 3 min | |
| A3 (comp) | 300 | | | 4.0 |
| A1 (inv) | 25 | 1000 | 18 s | |
| A1 (inv) | 50 | 850 | | |
| A1 (inv) | 100 | 650 | | |
| A1 (inv) | 300 | | | 0.4 |

As can be seen A1 is superior to A3 in antifoaming performance. More importantly, A1 has negligible interaction with the silver iodide emulsion made in oxidized gelatin, whereas A3, with a larger amount of ethylene oxide units per molecule, has a strong affinity for the silver halide surface, causing the displacement of the peptizer and subsequent clumping which is manifested by the fouling of the filter. This serves to demonstrate that antifoamants in accordance with the invention comprising a limited number of ethylene oxide units are unique among the class of materials (ethoxylated alcohols) in providing antifoaming without interaction with the silver halide emulsion.

Example 4

Preparation of Emulsion E1 (Comparison)

To a reactor incorporating a stirring device as disclosed in *Research Disclosure*, Item 38213, and containing 8.756 kg of distilled water, 25 mg of p-glutaramidophenyl disulfide and 251 g of bone gelatin and 1.59 g of antifoamant A4, were added 291 g of 3.8 M sodium chloride salt solution such that the mixture was maintained at a pCl of about 1.05 at approximately 68° C. To this were added 1.9 of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 74 mL/min for about 39 minutes while maintaining pCl constant at about 1.05. Both the silver and sodium salt solution pumps were then turned off and about 0.8 M potassium iodide solution was added to the stirred reaction mixture over about 30 seconds at a constant flow rate of about 62.9 mL/min. The resultant iodochloride emulsion was then grown further by conventional controlled double-jet addition for about 4.5 minutes by resumed addition of silver and sodium salt solutions at about 74 mL/min at a pCl of about 1.05. In addition, cesium pentachloronitrosylosmate was added at approximately 4 to 70% into the precipitation and potassium hexacyanoruthenate at 75–80%. A silver iodochloride emulsion was thus prepared with 0.2 mole % iodide located at 90% of total grain volume. Cubic edge length was 0.64 μm.

Preparation of emulsion E2 (Invention)

Emulsion E2 was prepared in an identical manner as E1, except that instead of antifoam A4, antifoam A1 in the amount of 1.6 g was added to the reactor.

A portion of each of these silver iodochloride emulsions E1 and E2 were optimally sensitized by the addition of p-glutaramidophenyl disulfide followed by the addition of a colloidal suspension of aurous sulfide and heat ramped to 60° C. during which time blue sensitizing dye (Dye-1), potassium hexachloroiridate, Lippmann bromide, and 1-(3-acetamidophenyl)-5-mercaptotetrazole were added.

Dye-1

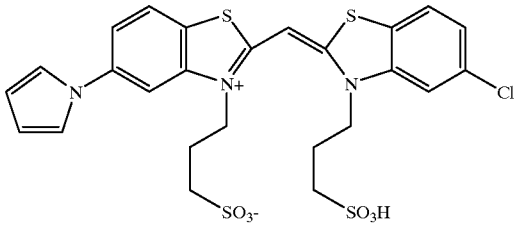

Blue sensitized emulsions E1 and E2 were coated on paper support at 19.5 mg silver per square foot and yellow dye forming coupler Y-1 at 50 mg per square foot. The coatings were overcoated with gelatin layer and the entire coating was hardened with bis(vinylsulfonylmethyl)ether.

Y-1

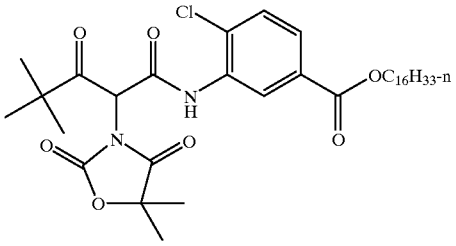

Single layer samples were exposed for 0.1 second to simulate exposure through a color negative film. A 0–3.0 density step tablet was used and the source of white light was a Kodak Model 1B sensitometer with a color temperature of 3000° K and with a combination of the appropriate filters. The exposed coatings were processed using Kodak™ Ektacolor RA-4 processing.

Relative log speed was measured at 0.8 absolute density at $1/10^{th}$ second exposure time. Dmin was measured at the unexposed part of the strip. In addition, Dmin growth (with the comparison sample designated as 100% growth) on 2 week keeping stability test (at 49° C. (120° F.) and Relative Humidity at 50%) were measured. Significant reduction in Dmin keeping was observed.

TABLE 5

Photographic evaluation of the antifoamant

| Emulsion | Antifoamant | Speed | Dmin | % Dmin growth on keeping |
|---|---|---|---|---|
| E1 Comparison | A4 | 100.0 | 0.061 | 100 |
| E2 Invention | A1 | 100.9 | 0.063 | 64 |

The invention has been described in detail with particular reference to certain preferred embodiments thereof, but it will be understood that variations and modifications can be effected within the spirit and scope of the invention.

What is claimed is:

1. In a process for forming a silver halide photographic emulsion comprising precipitating silver halide grains in an aqueous dispersing medium to which has been added silver and halide salt solutions while agitating the dispersing medium, the improvement wherein the precipitation is done in the presence of an antifoamant compound of the formula $$RO(CH_2CH_2O)_nH$$

wherein R represents an alkyl or alkenyl group containing 10 to 25 carbon atoms, or mixtures thereof, and n represents a mean value of from 2 to 4.

2. A process according to claim 1, wherein R represents an alkyl or alkenyl group containing 16 to 18 carbon atoms.

3. A process according to claim 1, wherein R represents an alkyl or alkenyl group of 18 carbon atoms.

4. A process according to claim 1, wherein the antifoamant is of the formula $C_9H_{18}{=}C_9H_{17}O(CH_2CH_2O)_nH$.

5. A process according to claim 1, wherein n represents a mean value of from 2 to 3.

6. A process according to claim 5, wherein R represents an alkyl or alkenyl group containing 16 to 18 carbon atoms.

7. A process according to claim 5, wherein R represents an alkyl or alkenyl group of 18 carbon atoms.

8. A process according to claim 5, wherein the antifoamant is of the formula $C_9H_{18}{=}C_9H_{17}O(CH_2CH_2O)_nH$.

9. A process according to claim 1, wherein the aqueous dispersing medium comprises a gelatino-peptizer.

10. A process according to claim 9, wherein the antifoamant is added to the aqueous dispersing medium in the form of a small particle dispersion, wherein the particle size of the dispersion is from 0.02 μm to 100 μm, and wherein the concentration of the antifoamant in the small particle dispersion is 0.1 to 50 weight percent.

11. A process according to claim 10, wherein the small particle dispersion is prepared in the presence of gelatin, such that the gelatin concentration in the small particle antifoamant dispersion is 1 to 25 weight percent.

12. A process according to claim 10, wherein the particle size of the dispersion is from 0.02 μm to 2 μm.

13. A process according to claim 9, wherein the amount of antifoamant in the dispersing medium is from 1 ppm to 0.1% of the total weight of the emulsion that is made.

14. A process according to claim 9, wherein the gelatino-peptizer contains less than 30 μmoles of methionine per gram of gelatin.

15. A silver halide photographic material comprising a support upon which is coated at least one light sensitive silver halide emulsion layer, comprising a silver halide emulsion precipitated in accordance with claim 1.

* * * * *